US007304283B2

(12) United States Patent
Tholl et al.

(10) Patent No.: US 7,304,283 B2
(45) Date of Patent: Dec. 4, 2007

(54) TARGET TRACKING DEVICE FOR A FLIGHT VEHICLE

(75) Inventors: Hans Dieter Tholl, Uhldingen (DE); Joachim Barenz, Uhldingen (DE)

(73) Assignee: Diehl BGT Defence GmbH & Co. K.G., Überlingen (DE)

( * ) Notice: Subject to any disclaimer, the term of this patent is extended or adjusted under 35 U.S.C. 154(b) by 0 days.

(21) Appl. No.: 11/152,423

(22) Filed: Jun. 14, 2005

(65) Prior Publication Data

US 2005/0279913 A1 Dec. 22, 2005

(30) Foreign Application Priority Data

Jun. 17, 2004 (DE) ..... 10 2004 029 343

(51) Int. Cl.
*G01C 21/02* (2006.01)
*F41G 7/00* (2006.01)

(52) U.S. Cl. ..... 250/203.2; 244/3.16

(58) Field of Classification Search ..... 250/203.2; 356/139.03; 342/54, 56, 62, 63; 244/3.15–3.18
See application file for complete search history.

(56) References Cited

U.S. PATENT DOCUMENTS

| | | | | |
|---|---|---|---|---|
| 3,754,249 | A * | 8/1973 | Kearney, II | 342/54 |
| 4,100,545 | A | 7/1978 | Tabourier | 342/62 |
| 4,407,465 | A | 10/1983 | Meyerhoff | 244/3.16 |
| 4,678,142 | A | 7/1987 | Hirschfeld | 244/3.16 |
| 4,769,533 | A * | 9/1988 | Groschl et al. | 250/206.2 |
| 4,867,034 | A | 9/1989 | Trosky et al. | 89/1.11 |
| 6,003,810 | A | 12/1999 | Roze des Ordons et al. | 244/3.16 |
| 6,111,241 | A * | 8/2000 | English et al. | 250/203.2 |
| 6,196,497 | B1 * | 3/2001 | Lankes et al. | 244/3.17 |
| 6,420,692 | B1 * | 7/2002 | Burroughs et al. | 250/214.1 |
| 6,766,979 | B2 | 7/2004 | Horwath | 244/3.17 |
| 6,817,569 | B1 | 11/2004 | Horwath | 244/3.17 |
| 2002/0109039 | A1 | 8/2002 | Horwath | 244/3.17 |

FOREIGN PATENT DOCUMENTS

| | | |
|---|---|---|
| GB | 1 468 237 | 3/1974 |
| GB | 1 552 369 | 12/1976 |

* cited by examiner

*Primary Examiner*—Thanh X. Luu
(74) *Attorney, Agent, or Firm*—Scully, Scott, Murphy & Presser, P.C.

(57) ABSTRACT

A target tracking device (2) for a flight vehicle (10) is specified which has a position-sensitive photodiode (4) with at least two signal outputs ($A_1$, $A_2$, $A_3$, $A_4$) which are respectively connected to a readout electronics (6), a control unit (8) which is connected to both readout electronics (6), and an optical lens unit (12) for imaging an illuminated point (15) of an object scene (14) on the photodiode (4), the readout electronics (6) respectively having an integration element for integrating a signal of the photodiode (4).

7 Claims, 3 Drawing Sheets

TARGET TRACKING DEVICE FOR A FLIGHT VEHICLE

BACKGROUND OF THE INVENTION

1. Field of the Invention

The present invention relates to a target tracking device for a flight vehicle.

2. Discussion of the Prior Art

Semiactive laser target homing heads can be used for guiding simple flight vehicles such as, for example, gliding or guided bombs or defence rockets. In this case, an operator marks a target with the aid of a laser, and the target tracking device detects the light spot on the target and guides the flight vehicle to the target. Such target guidance is cost effective and can be carried out very reliably. In order to detect the light source, a target guiding device can comprise a detector having, for example, four detector cells onto which the light spot is imaged. The flight vehicle is directed in this case such that as far as possible the same parts of the light spot are imaged on the four detector cells and thus centrally on or between the four detector cells. However, as such a narrow non-detecting area is arranged between the detector cells, target tracking carried out in such a way can lead to errors.

SUMMARY OF THE INVENTION

It is therefore the object of the present invention to specify a target tracking device for a flight vehicle with the aid of which the flight vehicle can be guided reliably to an illuminated target.

This object is achieved by means of a target tracking device for a flight vehicle which comprises according to the invention a position-sensitive photodiode with at least two signal outputs which are each connected to a readout electronics, furthermore comprise a control unit which is connected to both readout electronics, and additionally comprises an optical lens unit for imaging an illuminated point onto the object scene on the photodiode, the readout electronics respectively having an integration element for integrating a signal on the photodiode.

The invention proceeds in this case from the consideration that a position-sensitive photodiode permits spatial detection of an illuminated point imaged on the photodiode, without non-detecting points being arranged in the illuminated area of the photodiode. The point of the object scene is expediently to be very brightly illuminated for the purpose of reliable detection of the illuminated point. This can be done cost effectively by a laser which emits very bright and very short light pulses. Such a laser can be a Nd:YAG-laser, which typically has pulses with the duration of a few hundreds of a microsecond which are repeated with a pulse frequency of between 13 and 20 Hz.

By contrast with the detector having, for example four detector cells, a position-sensitive photodiode has an electrical bandwidth which can be substantially smaller than the bandwidth of the excitation by the light pulse of nanosecond length from the illuminated target object. As a result, the amplitude of an output signal of the photodiode is not proportional to the light irradiated onto the photodiode. Consequently, a conventional and simple measurement of the amplitude of a signal of an output of the position-sensitive photodiode can lead to erroneous results in the case of very short light pulses.

This error can be circumvented when the readout electronics connected to the signal outputs each have an integration element for integrating a signal of the photodiode. The signal shape essentially plays no role in this case and causes no measuring errors. It is possible in this way to make use of a cost effective laser, radiating with high pulse energy and short pulse duration, in conjunction with a relatively slow position-sensitive photodiode, it being possible for the position of an illuminated point imaged on the photodiode also to be detected highly accurately in a possibly nonlinear edge area of the photodiode. The readout electronics can be integrated in the control unit, or can be designed separately from the control unit.

In an advantageous refinement, the control unit is prepared for evaluating the signal of the photodiode and for detecting a pulse frequency of the diode signal. It is possible thereby to detect an integration time, tuned to the pulse frequency, of the evaluation electronics and, if appropriate, additionally to detect an item of coding information included in the pulse frequency.

The control unit is expediently prepared for comparing the pulse frequency with a stored frequency, and for running a target tracking routine upon agreement of the frequencies within the prescribed limits. It is possible to detect a coding of a laser illuminating the point, and to assign the illuminated point to the target tracking device. If a number of points are simultaneously illuminated by various marker lasers during a fight, these points can be illuminated at different pulse frequencies. The target tracking device of the flight vehicle detects the pulse frequency and compares the latter with the frequency stored in the target tracking device. Target tracking is started in the case of correspondence. If the frequencies do not correspond, the marker point is not to be detected by the target tracking device, but by another target tracking device, and no target tracking is started. In the event of movement of the flight vehicle relative to the illuminated point, the marker frequency can fluctuate somewhat for example as caused by the Doppler effect, depending on the relative velocity. Consequently, an agreement of the frequencies can also be present when the frequencies correspond within prescribed limits.

In a further variant of the invention, the control unit is prepared for detecting a phase angle of pulses of a pulse frequency of the signal of the photodiode. The diode signal is likewise pulsed in a fashion caused by the emission of laser pulses by the marker laser. It is advantageous for the purpose of obtaining an accurate measurement result when the integration interval in which the signal of the photodiode is integrated includes a known number of pulses, particularly one pulse, as completely as possible. It is possible in this way to avoid an only partial detection of one or more pulses.

The control unit is expediently prepared for prescribing an integration starting instant and an integration terminating instant as a function of the phase angle. The integration value can be specifically tuned to one or more pulses of the signal of the photodiode.

The position of the illuminated point on the photodiode can be measured quickly and without much influence exerted by background radiation when an integration interval between the integration starting instant and the integration transmission instant includes at most one pulse of a signal of the photodiode.

A further advantage is achieved when an integration interval between the integration starting instant and the integration terminating instant includes no pulse of a diode signal. The intensity of background radiation can thus be measured, without the result being distorted by active measuring radiation.

Particularly with a moving target, the intensity of the background radiation can fluctuate strongly with time. Consequently, in order to reduce a measuring error a further refinement of the invention prepares the control unit to provide between two integration intervals, each including at least one pulse of a diode signal, at least one integration interval, specifically at least two integration intervals which include no pulse of a diode signal.

It is proposed, furthermore, that the control unit is prepared for reading out one integrated signal each of the two outputs, for subtracting the two signals, for adding the two signals, for dividing the subtraction result by the addition result, and for outputting a control signal with the aid of the division result. The position of the projection of the illuminated point on the surface of the position-sensitive photodiode can be determined highly accurately with the aid of the division result, and it is possible therefrom to generate a control variable and, from that, a control signal. The disturbing effect of background radiation on the measurement result can be reduced by using a signal value caused by the background radiation to correct a signal value obtained by integrating a signal.

The photodiode advantageously comprises at least four signal outputs which are each connected to a readout electronics, the control unit being prepared for determining a variable characterizing the position of the illuminated point on the surface of the photodiode. The photodiode can be scanned in two dimensions, and accurate target tracking can be achieved with a single position-sensitive photodiode.

BRIEF DESCRIPTION OF THE DRAWINGS

Further advantages emerge from the following description of the drawing, which illustrates an exemplary embodiment of the invention. The drawing, the description and the claims include numerous features in combination. The person skilled in the art will expediently also consider the features individually and put together further rational combinations therefrom.

In the drawing.

DETAILED DESCRIPTION OF THE INVENTION

Figure 1:
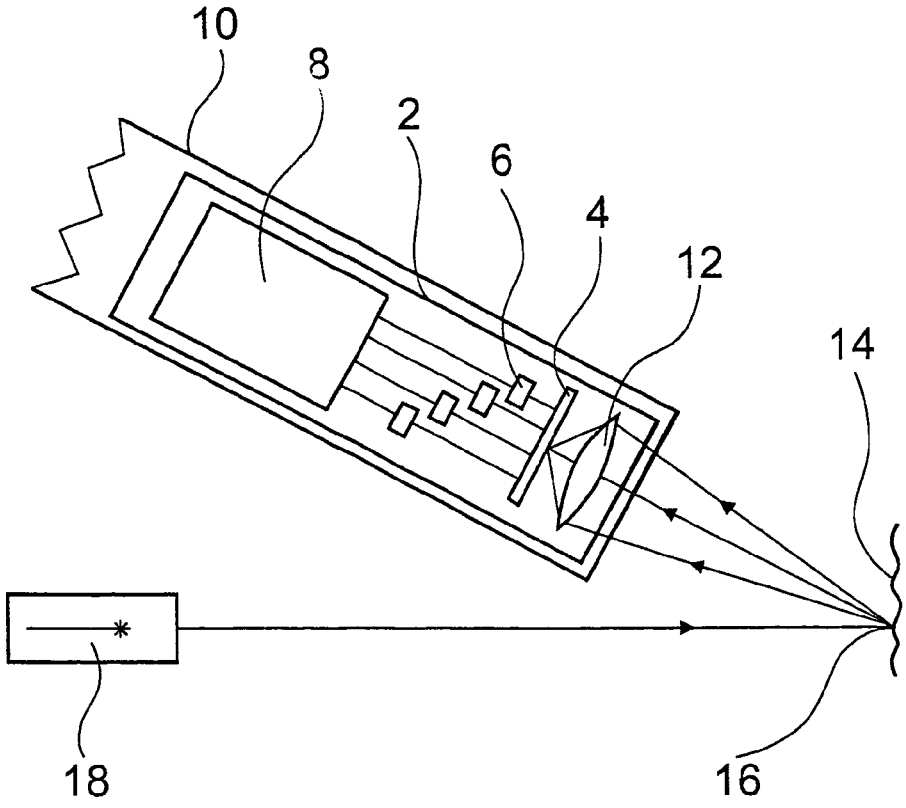
FIG. 1 shows a flight vehicle having a target tracking device, and a marker laser, in a diagrammatic illustration.
Figure 2:
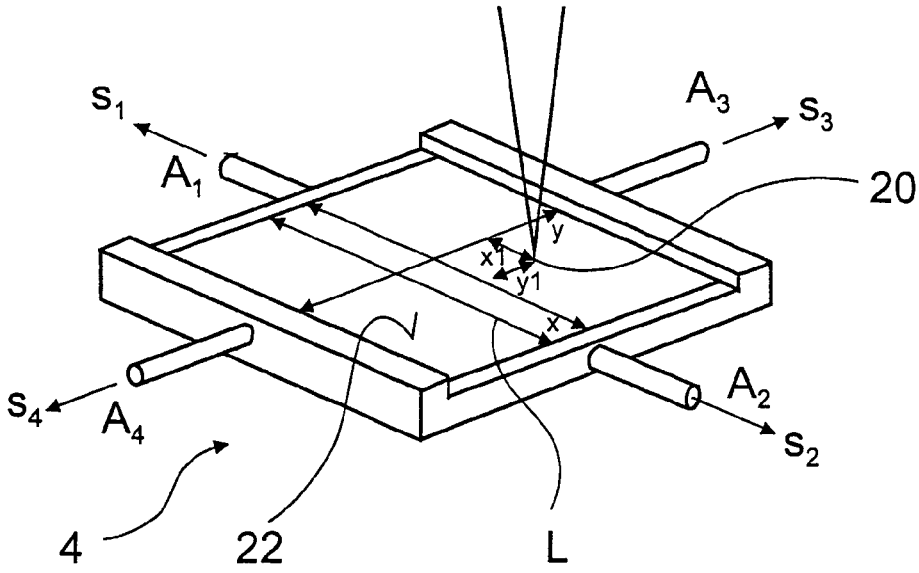
FIG. 2 shows a position-sensitive photodiode with four signal outputs.

FIG. 1 shows a very diagrammatic illustration of a target tracking device 2 having a position-sensitive photodiode 4, which is illustrated in more detail in FIG. 2. The photodiode 4 comprises four signal outputs $A_1$, $A_2$, $A_3$, $A_4$ which are each connected to a readout electronics 6. Likewise connected to the readout electronics 6 is a control unit 8, which is provided for target tracking and thus for controlling a flight vehicle 10. The target tracking device 2 is arranged in a homing head of the flight vehicle 10 and includes in its front part a lens unit 12 indicated diagrammatically by a single lens. The lens unit 12 serves for imaging an object scene 14 on the photodiode. A point 16 on this object scene 14 is illuminated by a marker laser 18 which is held by an operator and directed onto the point 16. The illuminated point 16 of the object scene 14 is imaged by the lens unit 12 in a small area, denoted below as point 20, of a radiation-sensitive surface 22 of the photodiode 4.

The irradiation of light onto the point 20 triggers a signal $s_1$, $s_2$, $s_3$, $s_4$ at each of the signal outputs $A_1$, $A_2$, $A_3$, $A_4$. The level of the respective signal $s_1$, $s_2$, $s_3$, $s_4$ depends on the intensity of the light irradiated into the point 20, and on the position of the point 20 inside the surface 22. The closer the point 20 is to the signal output $A_3$, for example, the higher the level of the signal $s_3$ at the signal output $A_3$, and the lower the level of the signal $s_4$ at the opposite signal output $A_4$. The signals $s_1$, $s_2$, $s_3$, $s_4$ are all at the same level given a position of the point 20 exactly at the midpoint of the surface 22.

The lens unit 12 is set such that given accurate alignment of the flight vehicle 10 with the illuminated point 16 of the object scene 14, this point 16 is imaged exactly at the midpoint of the surface 22. The larger a difference between the signals $s_1$ and $s_2$ or the signals $s_3$ and $s_4$, the more oblique the alignment of the flight vehicle 10 with the direct line between the flight vehicle 10 and the illuminated point 16. Consequently, in order to determine the flight direction of the flight vehicle 10 relative to the illuminated point 16, the position of the point 20 on the surface 22 or the signal difference between the two signals $s_1$, $s_2$ or $s_3$, $s_4$ is therefore determined using the following relationship:

$$\frac{x}{L} = \frac{\int_{t1}^{t2} s_1(t)\,dt - \int_{t1}^{t2} s_2(t)\,dt}{\int_{t1}^{t2} s_1(t)\,dt - \int_{t1}^{t2} s_2(t)\,dt}, \tag{1}$$

L being the extent of the light-sensitive surface 22 in the x-direction, $t_1$ being an integration starting instant, and $t_2$ being an integration terminating instant. The position of the point 20 in the y-direction is determined in a similar way.

Figure 3:
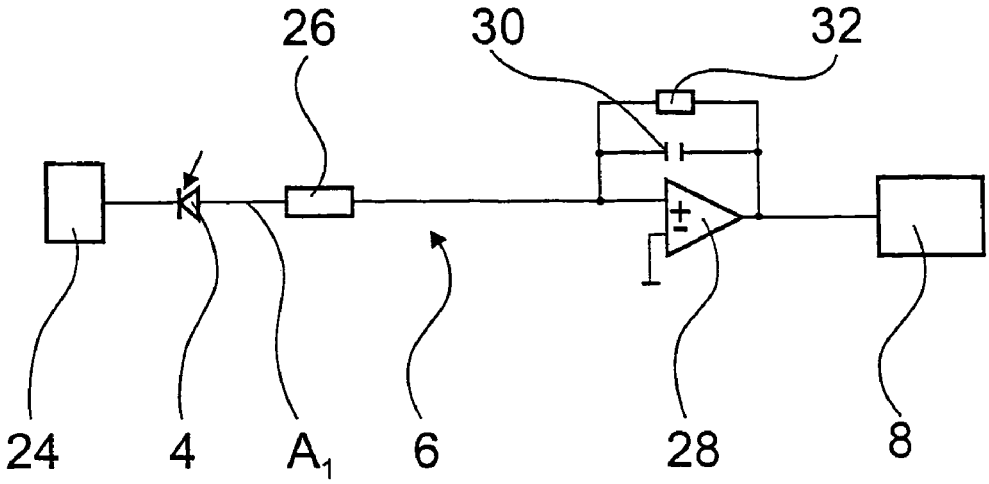
FIG. 3 shows a readout electronics with an integration element.

The integrated signals $s_1$, $s_2$, $s_3$, $s_4$ are obtained with the aid of the four readout electronics 6, of which one is illustrated in FIG. 3. The readout electronic 6 is arranged between the control unit 8 and the photodiode 4, which is connected to a voltage source 24. The readout electronic 6 comprises an ohmic resistor 26, an analogue amplifier 28 and a capacitor 30 which is bridged by a switchable resistor 32. A signal $s_1$ passing the signal output $A_1$ is amplified by the analogue amplifier 28, the result being to charge the capacitor 30. Upon termination of an integration interval, the charge of the capacitor can be read out by the control unit 8 in the form of a voltage present across the capacitor, and the level of the signal $s_1$ can thereby be determined.

Figure 4:
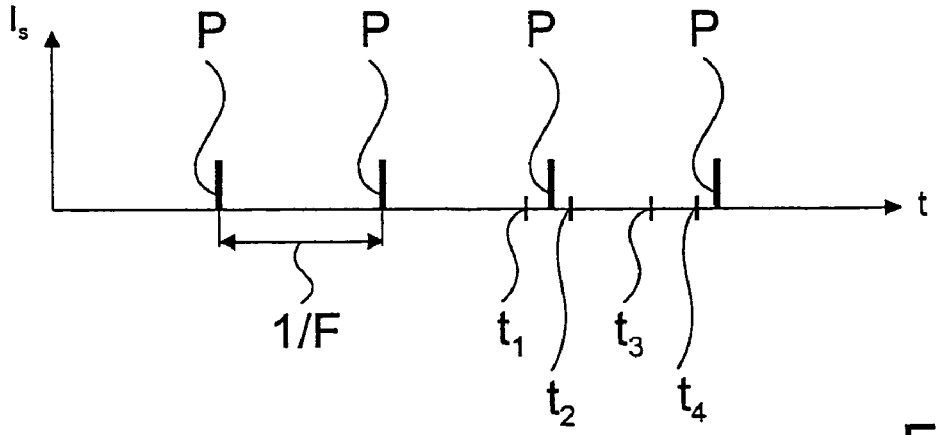
FIG. 4 shows a diagram with a sequence of pulses of a diode signal, FIG. 5 show a detail from the diagram of FIG. 4 with one pulse.

A signal level $I_s$ is plotted against a time t in a diagram in FIG. 4. At regular intervals, the control unit 8 records a pulse P of the signals $s_1$, $s_2$, $s_3$, $s_4$, at one, several or all signal outputs $A_1$, $A_2$, $A_3$, $A_4$. The control unit 8 uses the time interval between the pulses to determine a pulse frequency F and compares the latter with a frequency stored in the control unit 8. If the two frequencies agree within prescribed limits, the phase angle, determined with the aid of the control unit 8, of the pulse P is used to fix an integration starting instant $t_1$ and an integration terminating instant $t_2$ which mark the beginning and the end of an integration interval.

Figure 5:
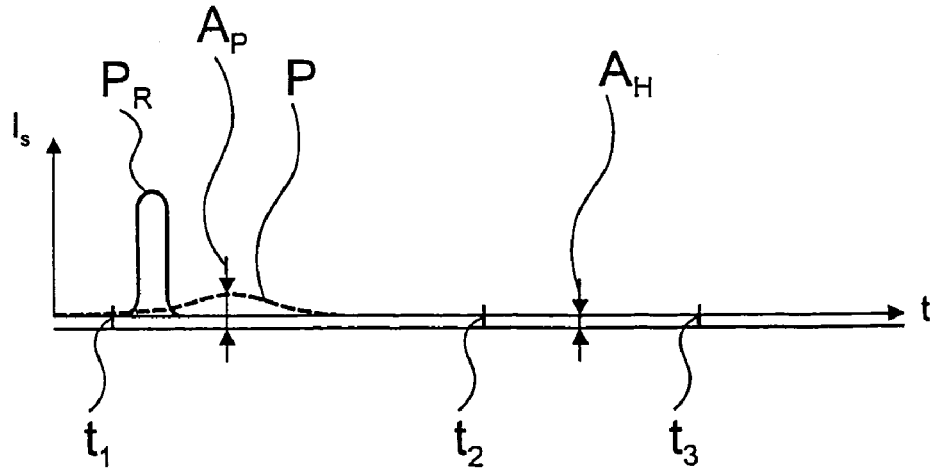

An integration interval is illustrated in an enlarged fashion in FIG. 5. A reflection pulse $P_R$ of a laser pulse reflected by the point 16 of the object scene 14 is depicted in addition to a pulse P of one of the signals $s_1$, $s_2$, $s_3$, $s_4$. The reflection pulse $P_R$ has a pulse duration of 30 ns. The reflection pulse $P_R$ triggers the pulse P which, however, lasts substantially longer in relation to the reflection pulse $P_R$ and does not have so large an amplitude $A_P$. The integration interval beginning at the integration starting instant $t_1$ and ending at the integration terminating instant $t_2$ completely surrounds the pulse P. The energy input by the reflection pulse $P_R$ into the photodiode 4 is thereby completely detected—except for unavoidable losses.

The signal of a background radiation with a background amplitude of $A_H$ underlies the pulse P. This background amplitude $A_H$ is substantially constant or a noise. In order to detect the background radiation, the control unit 8 controls a second integration interval between an integration starting instant $t_3$ and an integration terminating instant $t_4$. No pulse P is situated in this second integration interval, and so only the signal of the background radiation is detected. The first and second integration intervals are of equal length in this case, the second integration interval ending shortly before a following pulse P. In order to detect any possible fluctuation in the background radiation, a number of second integration intervals can be arranged between two pulses.

Before the signals $s_1$, $s_2$, $s_3$, $s_4$ are processed in accordance with the above formula (1), each integrated signal value is corrected in accordance with the following relationship:

$$s_i^{korr}=s_i-s_1^{back} \quad (2),$$

$s_i^{back}$ being the integrated signal value of the background radiation.

Figure 6:
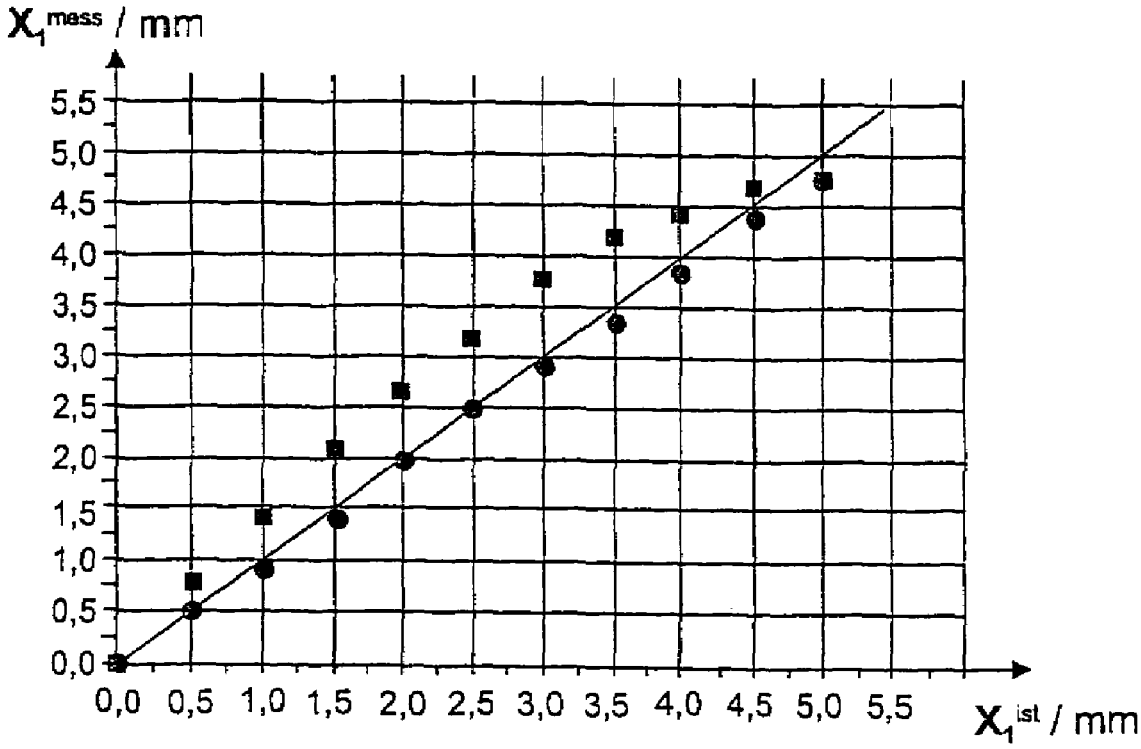
FIG. 6 shows a diagram with measured positions of projections of an illuminated point on the photodiode.

A measured position $x_1^{mess}$ of the point 20 imaged on the surface 22 is plotted in FIG. 6 in the x direction against the actual position $x_1^{ist}$. Here, round points plot the position, determined using the abovedescribed method, of the point 20 on the surface in the x direction, whereas square points plot the position that is determined by using the pulse amplitude $A_P$ instead of the respectively integrated signal values. Occurring in particular at the edge of the surface 22 of size 1 cm×1 cm are nonlinearities which lead to errors in the determination of the position $x_1^{mess}$ and the pulse amplitude $A_P$ is used as measured variable. The use of the integrated signal values, by contrast, leads to a linearly running measurement result. A small deviation of the measured positions $x_1^{mess}$ from the true position $x_1^{ist}$ marked by the continuous line can be corrected with the aid of a correction table stored in the control unit 8.

| Reference symbols | |
|---|---|
| 2 | Target tracking device |
| 4 | Photodiode |
| 6 | Readout electronics |
| 8 | Control unit |
| 10 | Flight vehicle |
| 12 | Lens unit |
| 14 | Object scene |
| 16 | Point |
| 18 | Marker laser |
| 20 | Point |
| 22 | Surface |
| 24 | Voltage source |
| 26 | Resistor |
| 28 | Analogue amplifier |

-continued

| Reference symbols | |
|---|---|
| 30 | Capacitor |
| 32 | Resistor |
| $A_1$ | Signal output |
| $A_2$ | Signal output |
| $A_3$ | Signal output |
| $A_4$ | Signal outpL: |
| $A_H$ | Background amplitude |
| $A_P$ | Pulse amplitude |
| F | Pulse frequency |
| L | Extent |
| P | Pulse |
| $P_R$ | Reflection pulse |
| $s_1$ | Signal |
| $s_2$ | Signal |
| $s_3$ | Signal |
| $s_4$ | Signal |
| $t_1$ | Integration starting instant |
| $t_2$ | Integration terminating instant |
| $t_3$ | Integration starting instant |
| $t_4$ | Integration terminating instant |

The invention claimed is:

1. Target tracking device (2) for a flight vehicle (10), having a position-sensitive photodiode (4) facilitating spatial detection of an illuminated point imaged on the photodiode and in the absence of any non-detecting points being arranged in the illuminated area of the photodiode, with at least two signal outputs ($A_1$, $A_2$, $A_3$, $A_4$) which are each connected to a respective readout electronics (6), a control unit (8) which is connected to both said readout electronics (6), and an optical lens unit (12) for imaging from the outside of the target tracking device by a marker laser (18) an illuminated point (15) of an object scene (14) on the photodiode (4), the readout electronics (6) each respectively having an integration element for integrating a signal of the photodiode (4), said control unit (8) detecting a phase angle of pulses (P) of a pulse frequency (F) of the signal of the photodiode (4), and said control unit (8) prescribing an integration starting instant ($t_1$, $t_3$) and an integration terminating instant ($t_2$, $t_4$) as a function of the phase angle.

2. Target tracking device (2) according to claim 1, characterized in that the control unit (8) evaluates the signal of the photodiode (4) and detects a pulse frequency (F) of the signal of the photodiode (4).

3. Target tracking device (2) according to claim 2, characterized in that the control unit (8) compares the pulse frequency (F) with a stored frequency, and runs a target tracking routine upon agreement of the frequencies within prescribed limits.

4. Target tracking device (2) according to claim 1, characterized in that an integration interval between the integration starting instant ($t_1$, $t_3$) and the integration terminating instant ($t_2$, $t_4$) includes at most one pulse (P) of a signal of the photodiode (4).

5. Target tracking device (2) according to claim 1, characterized in that an integration interval between the integration starting instant ($t_1$, $t_3$) and the integration terminating instant ($t_2$, $t_4$) is in the absence of a pulse (P) of a signal of the photodiode (4).

6. Target tracking device (2) according to claim 1, characterized in that the control unit (8) reads out one integrated signal from each of the at least two signal outputs ($A_1$, $A_2$, $A_3$, $A_4$), subtracts the two signal values ($s_1$, $s_2$, $s_3$, $s_4$) obtained by said reading out, adds the two signal values ($s_1$, $s_2$, $s_3$, $s_4$), divides the subtraction result by the addition result, and outputs a control signal with the aid of the division result.

7. Target tracking device (2) according to claim 1, characterized in that the photodiode (4) comprises at least two signal outputs ($A_1$, $A_2$, $A_3$, $A_4$) which are each connected to a respective said readout electronic (6), and the control unit (8) determines a variable characterizing the position of an illuminated point (20) on a surface (22) of the photodiode (4).

* * * * *